US005818401A

United States Patent [19]

Wang

[11] Patent Number: 5,818,401

[45] Date of Patent: Oct. 6, 1998

[54] DISPLAY APPARATUS

[76] Inventor: Tsun-chih Wang, No. 16, 34th Rd. Taichung Industrial Park, Taichung, Taiwan

[21] Appl. No.: 634,253

[22] Filed: Apr. 18, 1996

[51] Int. Cl.[6] ..... G09G 3/00

[52] U.S. Cl. ..... 345/31; 345/82; 340/815.45

[58] Field of Search ..... 345/31, 4, 5, 6, 345/82, 83, 46; 340/815.83, 815.84, 815.86, 815.45

[56] References Cited

U.S. PATENT DOCUMENTS 4,160,973 7/1979 Berlin, Jr. ..... 345/31
4,689,604 8/1987 Sokol ..... 345/31
5,302,965 4/1994 Belcher et al. ..... 345/31

*Primary Examiner*—Steven J. Saras
*Assistant Examiner*—Xu-Ming Wu
*Attorney, Agent, or Firm*—Parkhurst & Wendel

[57] ABSTRACT

A display apparatus includes a pedestal, a cylindrical display body rotatably mounted on the pedestal, a plurality of light emitting lines composed of a plurality of units, each line being equidistantly and axially arranged on a wall of the display body for displaying information when the display body rotates, a control circuit mounted on the display body for controlling a rotating speed of the display body and the information displayed on the display apparatus, and a power supply having a positive electrode and a negative electrode provided within the pedestal for providing the power required by the apparatus.

5 Claims, 6 Drawing Sheets

DISPLAY APPARATUS

BACKGROUND OF THE INVENTION

The present invention relates to a display apparatus, and particularly to a display apparatus having a rotating display panel.

Conventionally, an electronic display board is composed of a great amount of light-emitting units, such as light emitting diodes (LEDs), fluorescent lamps, or liquid crystal displays. In the case of a 500*500 pixels display board, if the board applies a monochromatic display mode, it will require a total amount of 250,000 LEDs. Further, if it displays in three colors, the required amount of LEDs will be doubled. Apparently, more LEDs will increase the costs of the display board and induce a higher maintenance cost.

SUMMARY OF THE INVENTION

An object of the present invention is to provide a display apparatus which can overcome the disadvantages mentioned above.

According to the present invention, a display apparatus includes a pedestal, a cylindrical display body rotatably mounted on the pedestal, a plurality of light emitting lines composed of a plurality of units, each line being equidistantly and axially arranged on a wall of the display body for displaying information when the display body rotates, a control circuit mounted on the display body for controlling a rotating speed of the display body and the information displayed on the display apparatus, and a power supply having a positive electrode and a negative electrode provided within the pedestal for providing the power required by the apparatus.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
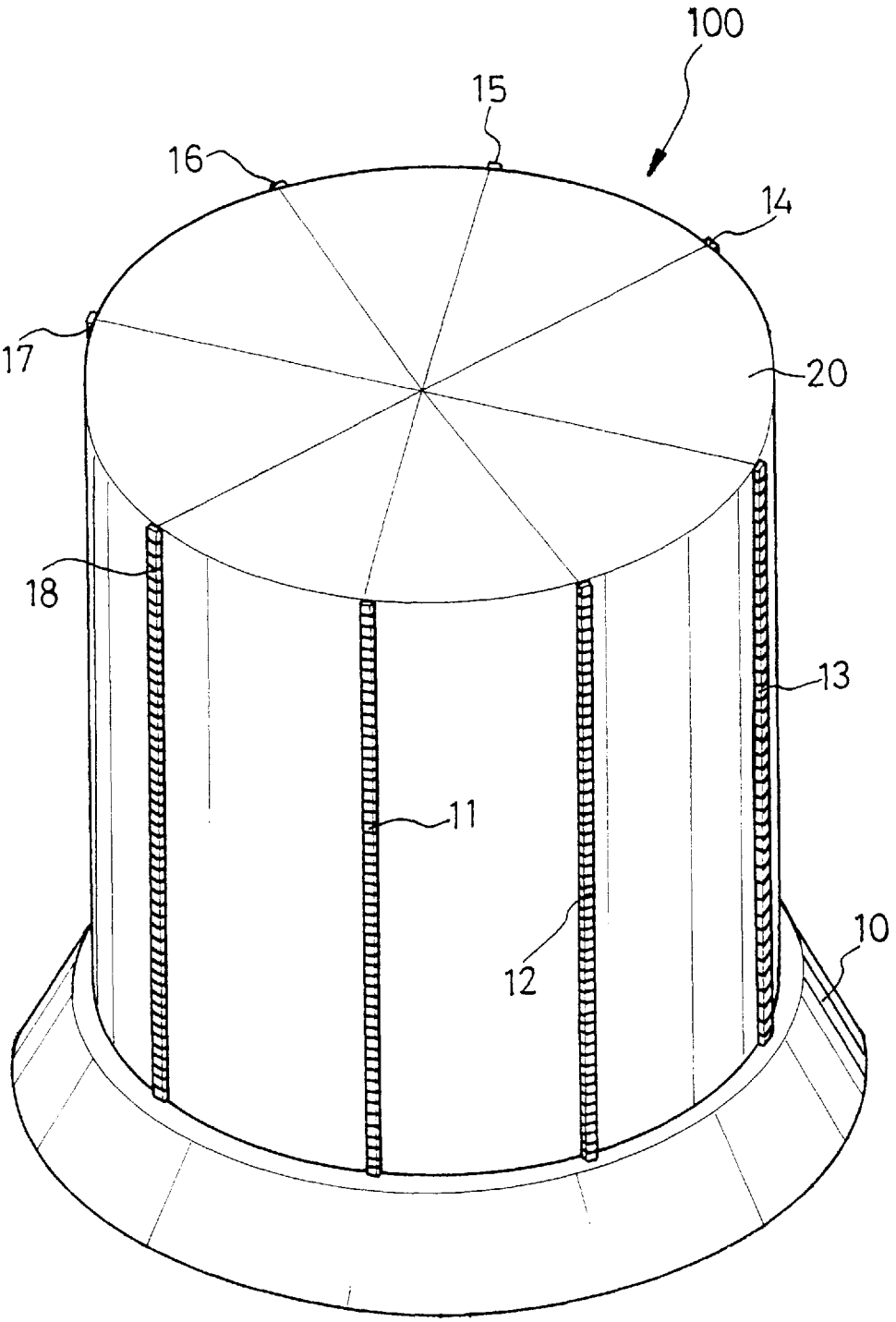
FIG. 1 is a schematic view of a first embodiment of a display apparatus according to the present invention.

Referring to FIG. 1, there is shown a perspective view of a display apparatus 100 in accordance with the present invention. As shown, the display apparatus 100 includes a pedestal 10, a cylindrical display body 20 rotatably mounted on the pedestal 10, a plurality of light emitting lines 11–18 radially and equidistantly secured on a wall of the cylindrical body 20, each of the light emitting lines 11–18 composed of a plurality of light emitting units, such as light emitting diodes (LEDs). For simplicity, hereinafter the light emitting units are referred to as LEDs.

When the display body 20 rotates at a speed that a human eye (not shown) cannot perceive the alternation of the light emitting lines 11–18 and the LEDs are sequentially turned on, a human may perceive a corresponding information displayed on the rotating body 20 due to the persistence of vision. Thus, if a distance between the lines 11 and 12 can be divided into 100 time intervals, i.e., 100 lines, then a total number of time intervals of 800 will be derived from the cylindrical display body 10. If each light emitting line has 500 LEDs, then a display frame will have 500*100=50,000 pixels.

In order to achieve a steady picture without flickering, the light emitting lines and the rotation speed of the display body have to meet certain conditions. In a normal case, a minimum frame rate is 24 frames per second. For this apparatus, the frame rate is a multiplication of the number of display lines and the rotating speed of the display body, thus, if the number of light emitting lines is 8, the rotation speed of the display body has to be 3 revolutions or above per second.

Figure 2:
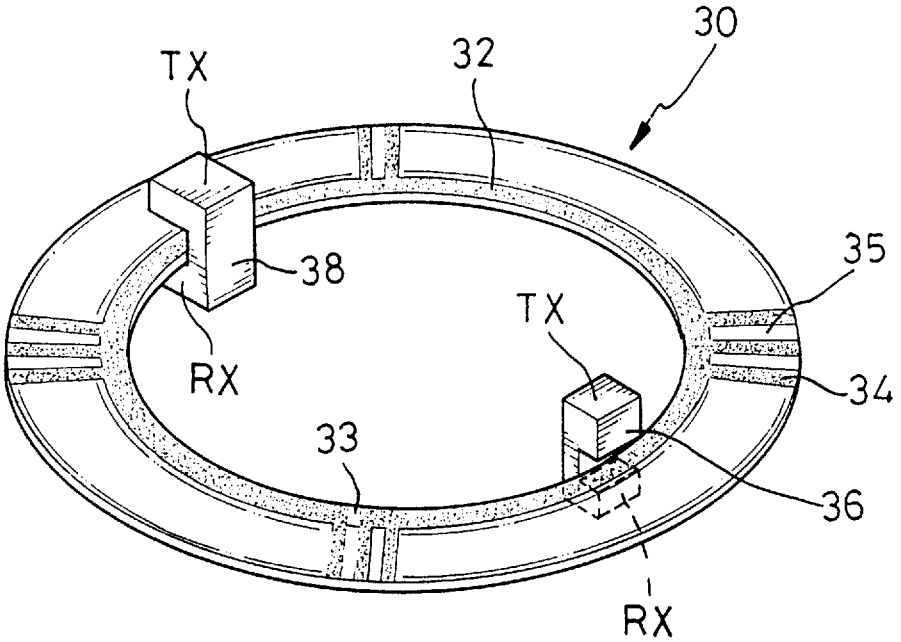
FIG. 2 is a schematic view of a toroidal grating and photo couplers according to the present invention.

A toroidal grating 30 for switching the ON/OFF of the LEDs in an appropriate time is shown in FIG. 2. The toroidal grating 30 is formed of a transparent plate coated with a annular opaque portion 32 on a surface extending from an inner diameter thereof and a plurality of opaque strips 34 radially extending out of the annular opaque portion 32 thereby defining a corresponding number of blanks 35. As shown, a transparent area 33 is provided on the annular opaque portion 32 and coincided with one of the blanks 35 for serving as an initial point when rotates. The total amount of the opaque strips 34 is equal to the number of the intervals on a periphery of the display body 20, such as 800 intervals as mentioned.

As shown in FIG. 2, a pair of photo interrupters 36, 38 are respectively provided at the inner diameter of the toroidal grating 30. The interrupters 36, 38 each have a transmitter part Tx and a receiver part Rx. The annular opaque portion 32 is inserted between the transmitter/receiver parts of the interrupter 36 and the opaque strips 34 are inserted between the transmitter/receiver parts of the interrupter 38 such that the photo interrupter 36 will output a signal to indicate an initial point of the intervals and the photo interrupter 38 will output signals to represent the time intervals.

Figure 3:
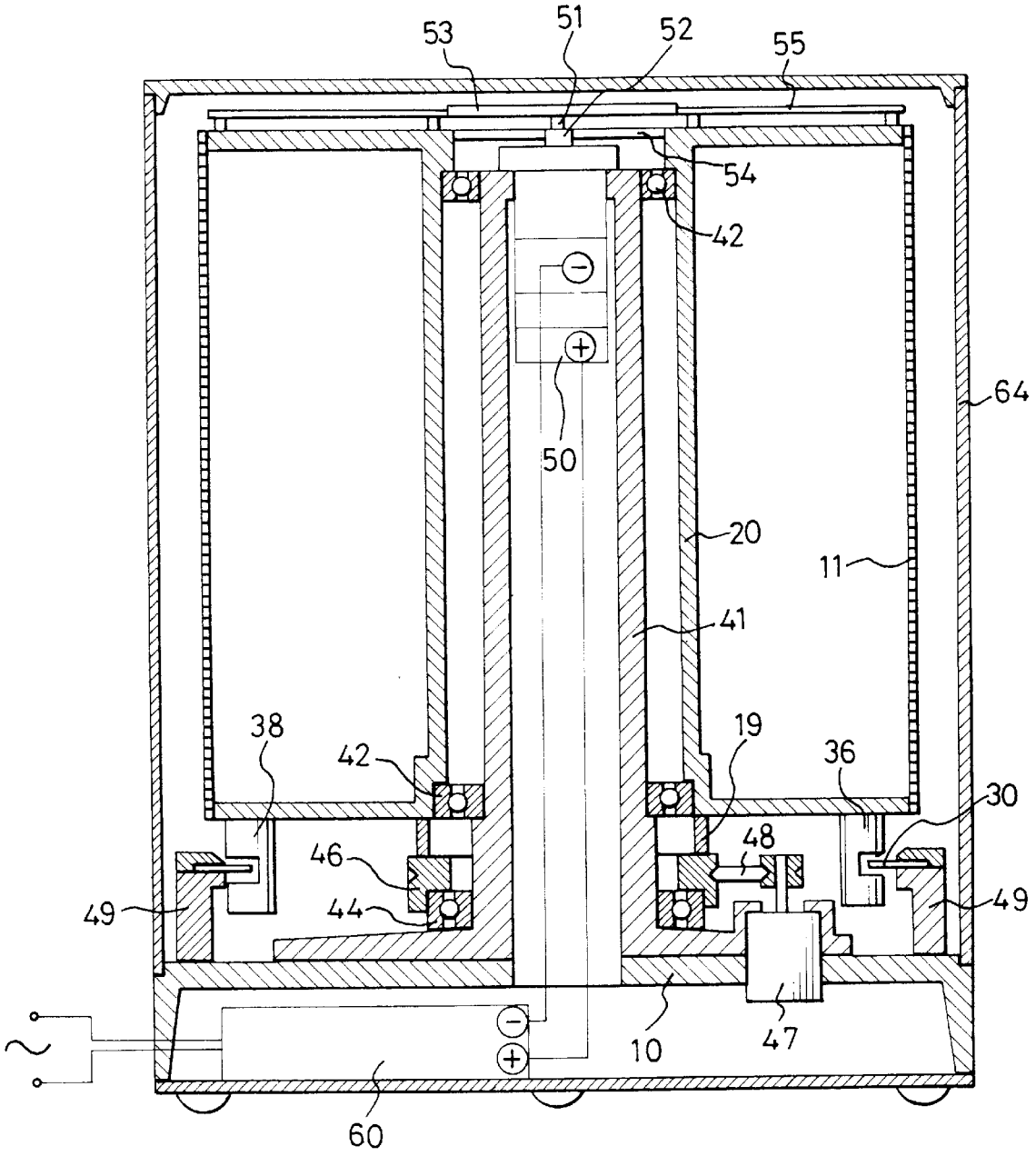
FIG. 3 is a cross-sectional view of a display apparatus according to the present invention.

Referring to FIG. 3, the pedestal 10 includes an upright shaft 41 and two bearings 42 respectively mounted on a top and an intermediate portion of the shaft 41 for rotatably coupling with the display body 20. A bearing 44 is secured on a bottom of the shaft 41. A roller 46 is rotatably mounted on the bearing 44 and mechanically linked to the display body 20 by a plurality of pins 19. A motor 47 is provided on the pedestal 10 for driving the roller 46 by means of a belt 48. The photo interrupters 36, 38 are secured under the display body 20. A plurality of studs 49 are provided on the pedestal 10 for securing the grating 30 in place.

The shaft 41 is hollow with a cylindrical brush 50 mounted within the top of the shaft 41. The brush 50 is electrically connected with a power supply 60 having a positive electrode and a negative electrode within the pedestal 10. A bar 51 and a coaxially arranged tube 52 electrically isolated from the bar 51 are respectively provided on the brush 50 and connected to the positive and the negative electrodes of the power supply 60. A disc 53 and a toroidal plate 54 both made of copper are securely mounted to the bar 51 and the tube 52, respectively, and electrically/mechanically connected to a toroidal printed circuit board 55, such that the disc 53, the toroidal plate 54, the rod 51, and the tube 52 will simultaneously rotate when the display body 20 rotates.

Figure 4:
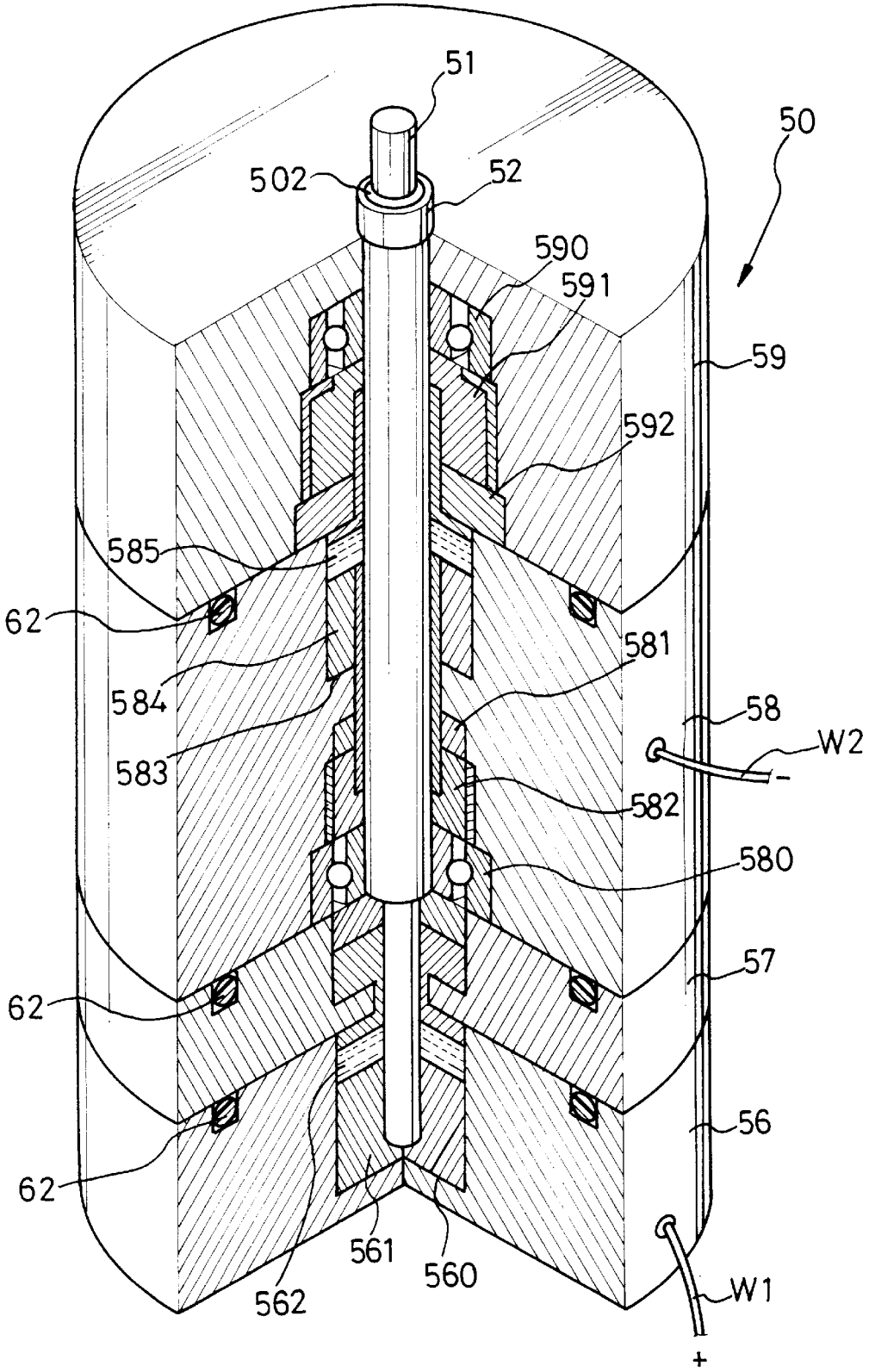
FIG. 4 is a partially cut-away view of a brush according to the present invention.

As shown in FIG. 4, the cylindrical brush 50 is formed of a copper base 56, an insulating block 57, a copper block 58, and an aluminum block 59 sequentially stacked and a plurality of 0-rings 62 sandwiched therebetween. The rod 51 and the tube 52 axially extend along a central axis of the brush 50.

The copper base 56 defines a chamber 560 in a center portion thereof for retaining mercury 561. An oil layer 562 is provided on the mercury 561 as to protect the mercury 561 from exposure to air and to prevent air permeating into the mercury 561. The rod 51 has a longer length than the tube 52 and is dipped into the mercury 561 retained by the base 56, which is coupled to the positive electrode of the power supply 60 in FIG. 3 via a conductor W1 as shown.

A bearing 580 and two seals 582, 581 are mounted on the tube 52 and retained under a bottom of the copper block 58 such that the tube 52 can rotate within the copper block 58, which coupled to the negative electrode of the power supply 60 in FIG. 3 via a conductor W2 as shown. The copper block 58 further defines a chamber 583 on the seal 581 for retaining mercury 584. An oil layer 585 is provided on the mercury 584. A bearing 590 and two seals 591, 592 are mounted on the tube 52 and secured within the aluminum block 59 for sealing the oil layer 585 and the mercury 584 within the chamber 583 such that the tube 52 can rotate within the brush 50. As shown, an insulation tube 502 is inserted between the rod 51 and the tube 52.

In this configuration, an electrical power supply can be transmitted to the disc 53 and toroidal plate 54 to illuminate the light emitting units on the display body.

Referring back to FIG. 3, a transparent housing 64 is provided for protecting the display apparatus from contaminants, such as dust.

Since a circuit designer of ordinary skill in the art could easily build the circuits required by the present invention a description related to control circuits on the printed circuit board 55 is omitted for the briefness of the specification.

Figure 5:
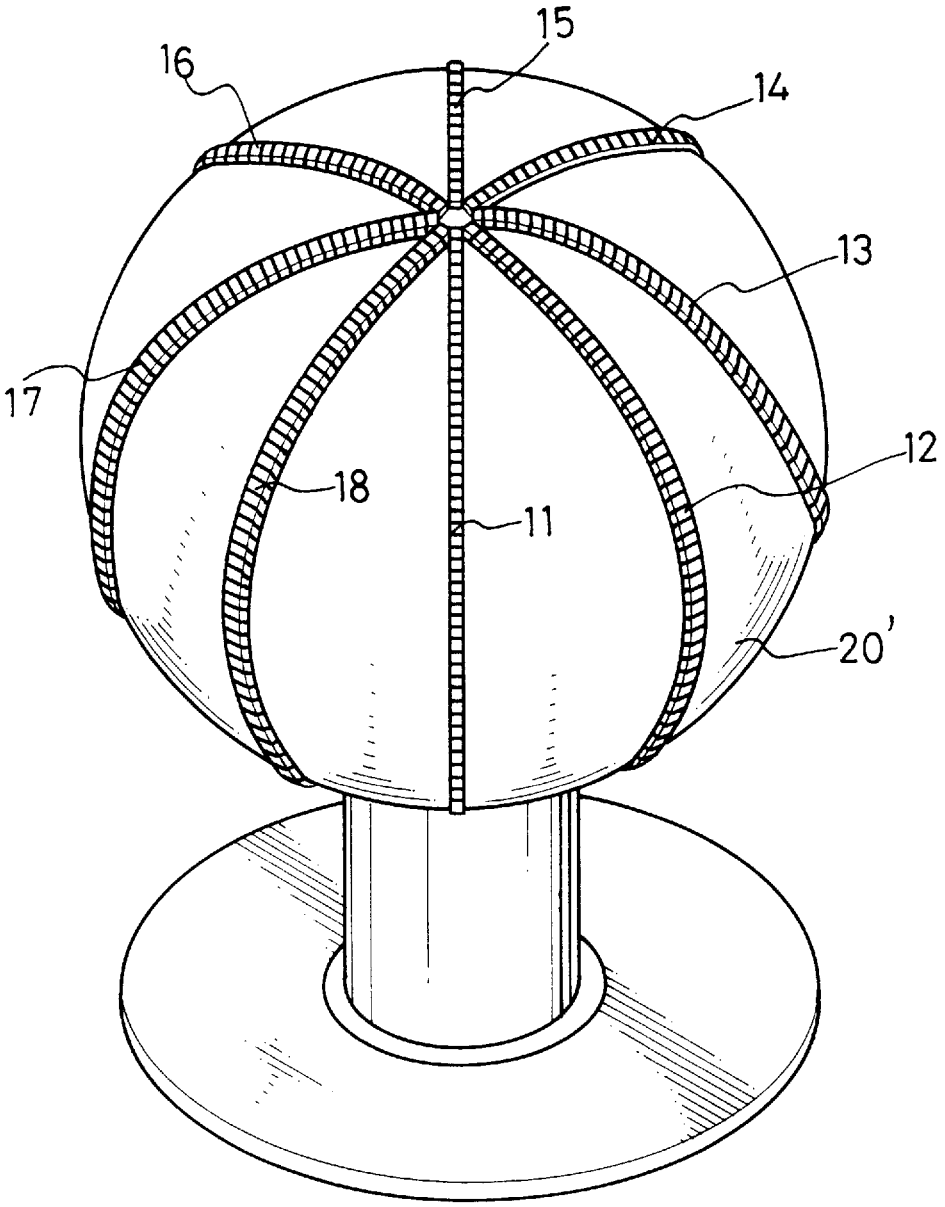
FIG. 5 is a perspective view of a second embodiment of the display apparatus of the present invention.
Figure 6:
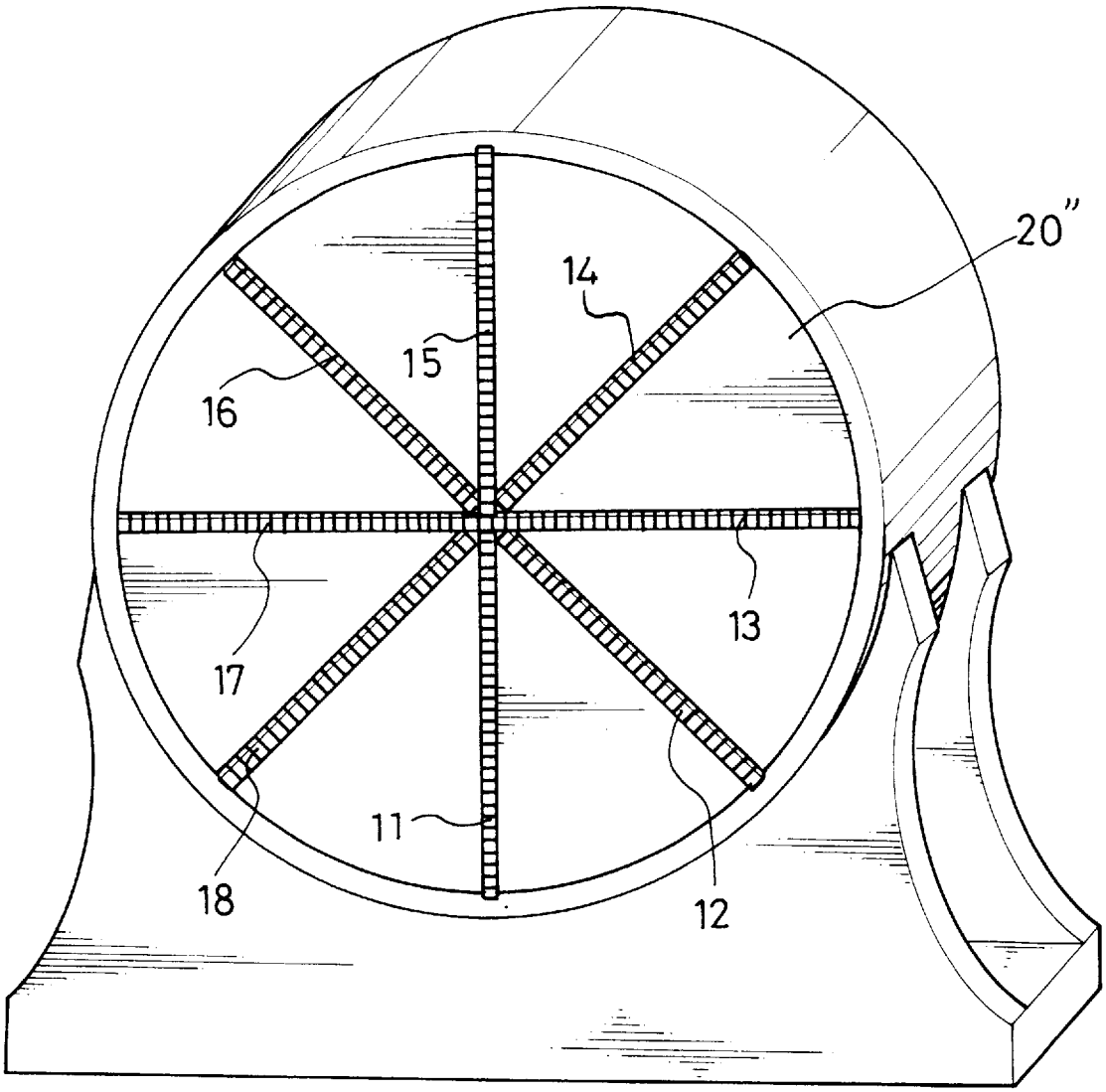
FIG. 6 is a perspective view of a third embodiment of the display apparatus of the present invention.

FIGS. 5 and 6 are two different configurations of the display bodies 20', 20". In FIG. 5, the display lines 11–18 are equi-spaced on a periphery of a spherical display body 20'. In this arrangement, a spherical display panel will be achieved when the display body 20' rotates. In FIG. 6, the display lines are placed on an axial surface of a roller body 20" and each of the lines is radially equi-spaced such that a circular display panel will be achieved when the display body 20" rotates.

Although the invention has been explained in relation to its preferred embodiment, it is to be understood that many other possible modifications and variations can be made without departing from the spirit and scope of the invention as hereinafter claimed.

What is claimed is:

1. A display apparatus, comprising:

a pedestal having an upright shaft with two bearings mounted thereon;

a cylindrical display body rotatably mounted on the pedestal;

a plurality of light-emitting lines comprising a plurality of units, each line being equidistantly and axially arranged on a wall of the display body for displaying information when the display body rotates;

a control circuit mounted on the display body for controlling a rotating speed of the display body and the information displayed on the display apparatus;

a power supply having a positive electrode and a negative electrode provided within the pedestal for providing the power required by the apparatus; and a toroidal grating secured on the pedestal and made of transparent material with a plurality of radially-extending opaque strips coated thereon thereby defining a corresponding number of blanks, and a first photo interrupter secured under the display body and having a transmitting portion and a receiving portion respectively on opposite sides of the grating for moving along a periphery of the toroidal grating when the display body rotates to output a signal to the control circuit for controlling the light-emitting units.

2. A display apparatus according to claim 1 wherein said toroidal grating having an annular opaque portion coaxially coated thereon and having a transparent area coincided with one of the blanks.

3. A display apparatus according to claim 2 further comprising a second photo interrupter secured under the display body and having a transmitter portion and a receiver portion for the annular opaque portion to move therebetween thereby outputting a signal to the control circuit for controlling the light emitting units.

4. A display apparatus, comprising:

a pedestal having an upright shaft with two bearings mounted thereon, wherein said shaft is hollow;

a cylindrical display body rotatably mounted on the pedestal;

a plurality of light-emitting lines comprising a plurality of units, each line being equidistantly and axially arranged on a wall of the display body for displaying information when the display body rotates;

a control circuit mounted on the display body for controlling a rotating speed of the display body and the information displayed on the display apparatus;

a power supply having a positive electrode and a negative electrode provided within the pedestal for providing the power required by the apparatus;

a brush mounted within the shaft;

a tube protruding from the brush and electrically connected to the negative electrode of the power supply;

a rod electrically connected to the positive electrode of the power supply with a length greater than the tube and inserted into the tube while electrically isolated from the tube;

a toroidal copper plate coaxially coupled with the tube and electrically connected to the control circuit; and a disk copper coupled with the rod and electrically connected to the control circuit.

5. A display apparatus according to claim 4 wherein said brush is composed of a copper base electrically connected to the positive electrode of the power supply and defining a chamber filled with mercury for the rod to be dipped therewithin, an insulating block, a copper block electrically connected to the negative electrode of the power supply and having a bearing coupled with the tube for the tube to rotate therewithin and a chamber filled with mercury for the tube to be dipped therewithin, and an aluminum block having a bearing coupled with the tube for the tube to rotate therewithin in a stacked manner and wherein said copper base, said insulating block, said copper block, and said aluminum block are sequentially stacked together.

* * * * *